US006145357A

United States Patent [19]

Stefanescu

[11] Patent Number: 6,145,357

[45] Date of Patent: Nov. 14, 2000

[54] FLAT KEY FOR A TUMBLER-CONTAINING LOCKING CYLINDER OF A LOCK APPARATUS

[75] Inventor: Alexander Stefanescu, Velbert, Germany

[73] Assignee: C. Ed. Schulte GmbH, Velbert, Germany

[21] Appl. No.: 09/022,660

[22] Filed: Feb. 12, 1998

[30] Foreign Application Priority Data

Feb. 27, 1997 [DE] Germany ..... 197 07 932

[51] Int. Cl.[7] ..... E05B 19/04

[52] U.S. Cl. ..... 70/406; 70/407

[58] Field of Search ..... 70/402–407

[56] References Cited

U.S. PATENT DOCUMENTS

| | | | |
|---|---|---|---|
| 4,168,617 | 9/1979 | Prunbauer | 70/406 |
| 4,320,638 | 3/1982 | Dunphy et al. | 70/358 |
| 4,653,298 | 3/1987 | Tietz | 70/406 |
| 5,131,249 | 7/1992 | Sieg | 70/406 |
| 5,287,712 | 2/1994 | Sieg | 70/406 |
| 5,493,884 | 2/1996 | Hinz et al. | 70/407 |
| 5,809,816 | 9/1998 | Widen | 70/493 |

FOREIGN PATENT DOCUMENTS 1928504 12/1970 Germany .

OTHER PUBLICATIONS

Definition of "Paracentric" from Webster's New International Dictionary, 2nd Ed., Circa 1952.

*Primary Examiner*—B. Dayoan
*Assistant Examiner*—Clifford B Vaterlaus
*Attorney, Agent, or Firm*—Martin A. Farber

[57] ABSTRACT

A flat key for a tumbler-containing locking cylinder of a locking apparatus, with a key grip and, attached thereto, a key shank for locking grooves cut into the shank towards the end surface, the shank having a basic profile exhibiting an essentially T-shaped cross-sectional configuration, of which the T-bar forms a guide bar with guiding surfaces, and of which the T-stem extending in the longitudinal mid-plane provides the end surface and has wide side surfaces for the provision of profile ribs that have curvilinear cross-sectional contours. The opposite disposed wide side surfaces (5, 6, 12, 13) each exhibit at least one longitudinal groove (7, 8, 15, 16) with a groove base extending beyond the longitudinal mid-plane (M—M), in which the groove side walls (7", 7'", 8", 8'", 15', 15", 16', 16") and the end surfaces (4, 14), seen in cross-section, extend circularly or elliptically tangentially from the wide surfaces (5, 6, 12, 13) in such a way that all of the profiling—profile ribs (17, 18, 19, 20), grooves (7, 8, 15, 16) and the end surfaces (4, 14)—of the wide side key surfaces have rounded front and flank portions.

11 Claims, 10 Drawing Sheets

FLAT KEY FOR A TUMBLER-CONTAINING LOCKING CYLINDER OF A LOCK APPARATUS

FIELD AND BACKGROUND OF THE INVENTION

The invention relates to a flat key for a tumbler-containing locking cylinder of a locking apparatus, with a key grip and, attached thereto, a key shank for locking grooves cut into the shank towards the end surface, the key shank having a basic profile exhibiting an essentially T-shaped cross-sectional configuration, of which the T-bar forms a guide bar with guiding surfaces, and of which the T-stem extending in the longitudinal mid-plane provides the end surface and has wide side surfaces for the provision of profile ribs that have curvilinear cross-sectional contours.

A flat key of the kind under discussion is known from DE1928504A1, in which the T-shaped basic profile forms a rectangularly arranged T-stem with a T-bar extending perpendicularly thereto. In order to accommodate different variations in the lock assembly profile, profile ribs are provided on the wide side surfaces in varying sequence, the profile ribs having curvilinear cross-sectional contours. Although such profile ribs are present, they are often accompanied by sharp edges or angles, which can lead to scratching and also to injury.

SUMMARY OF THE INVENTION

The object of the invention is to configure a flat key of the kind discussed in such a way that, when forming a profile variant, sharp edges and angles are essentially avoided.

This object is essentially obtained in a flat key of the above-mentioned type, it being provided that each of the opposed wide side surfaces exhibit at least one longitudinal groove with a groove base extending beyond the longitudinal mid-plane, in which the groove side walls and the end surfaces, seen in cross-section, extend circularly or elliptically tangentially from the wide side surfaces in such a way that all profiles—profile ribs, grooves and end surface of the wide side surfaces—of the key have rounded outer and flank portions.

In accordance with this kind of refinement, there is provided a flat key of the type under discussion which is distinguishable from other profile variants by a configuration which avoids edges and sharp angles. Another profile variant is characterized by the rounded end surface of the key shaft, having the effect of increased security. On the T-stem of the basic profile in the latter case, no outwardly projecting sharp edges are present. The oppositely disposed wide side surfaces extend tangentially with respect to the groove side walls and the rounded end surfaces. In connection with the profile ribs which exhibit curvilinear cross-sectional contours, what is achieved is that the entire profiling of the wide key surfaces is provided with rounded front and flank portions, while achieving the previously described scratch-free and injury-free configuration. Furthermore, the oppositely lying grooves are so disposed that they project beyond the longitudinal mid-plane of the key shank, achieving paracentricity. Based on the fact that all profiles have rounded front portions and flank portions, there is provided an abrasion-minimizing configuration of the flat key itself, as well as of the corresponding key channel of the corresponding locking cylinder. From a manufacturing point of view, it is advantageous to arrange for the groove base to be parallel with the longitudinal mid-plane of the key shank, with the guiding surfaces of the guide bar being perpendicular thereto. By this means, the key shank when inserted into the key channel is securely positioned. It is to be further noted that the side walls of all grooves including the end surface, have cross-sectional contours with the same circular or elliptical parameters. It is, however, possible to vary the circular or elliptical parameters for a key, particularly with reference to different circular radii and parameter axes. In addition, it is possible to provide a combination of circular and elliptical parameters for a given key shank. Further, the profile ribs may have a circular or elliptical contour such that, in the case of the latter, one of the half axes lies parallel to or within the longitudinal mid-plane. Furthermore, it is contemplated that the distance from the rib apex to the longitudinal mid-plane may be the same as or smaller than the stem projection beyond the longitudinal mid-plane. Also it is contemplated that the rib-generating contour lines of adjacent ribs may intersect one another. This can take place at a location spaced away from the respective wide side surface. A further profile variant can be characterized in that the contour line of at least one rib intersects the contour line of the basic profile in such a way as to define an acute undercut. In the incorporation of the inventive idea in a locking apparatus, which thus includes a plurality of locking cylinders and a corresponding number of flat keys with a correspondingly configured base profile, at least two keys are differently configured by reason of the different configuration of profile ribs, which would otherwise be identical.

BRIEF DESCRIPTION OF THE DRAWINGS

With the above and other objects and other advantages in view, the present invention will become more clearly understood in connection with the detailed description of preferred embodiments, when considered with the accompanying drawings of which.

DETAILED DESCRIPTION OF THE PREFERRED EMBODIMENTS

Figure 1:
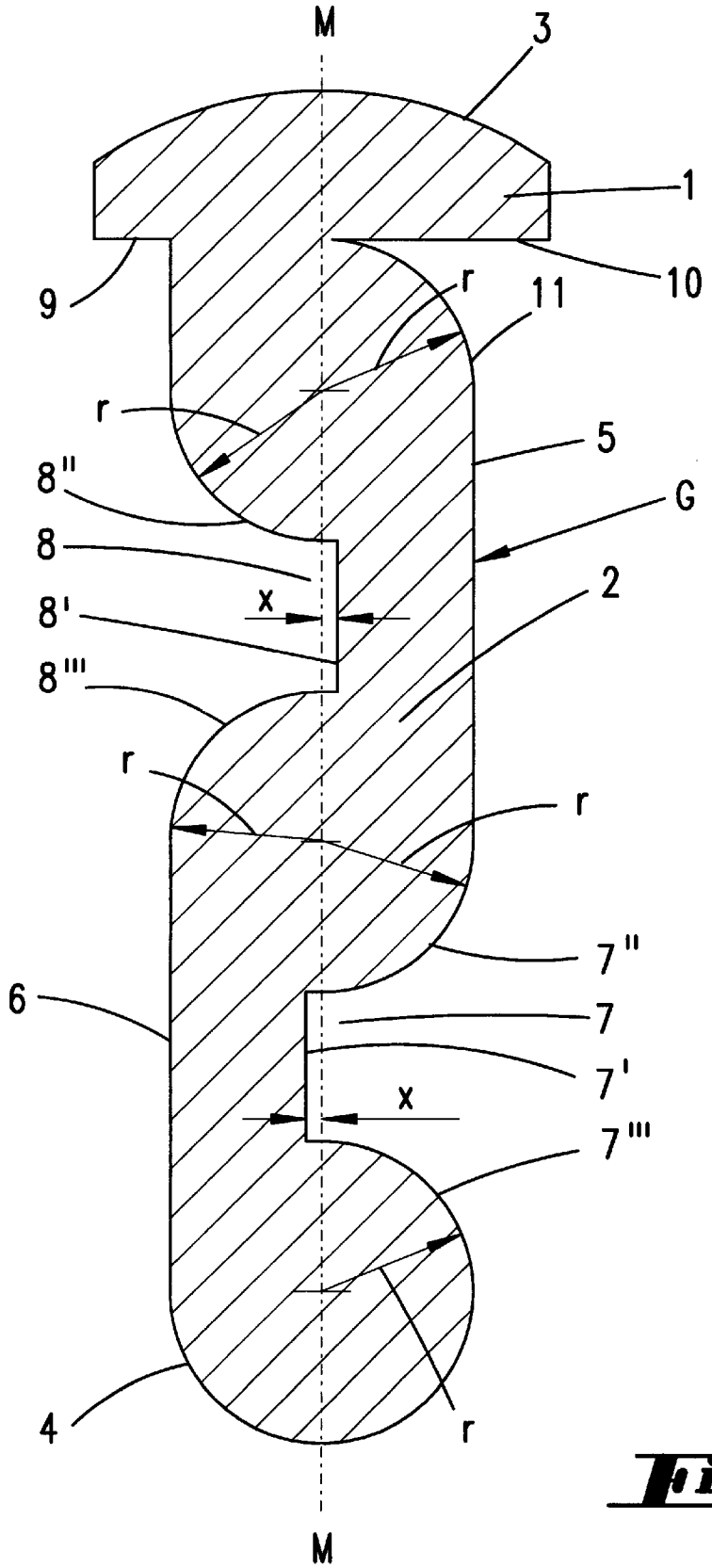
In FIG. 1, a cross-section through the basic profile of a key shank, in which basic profile the groove side walls and also the end surfaces are circularly configured, this being the first embodiment, In FIG. 2, a cross-section through the key shank which has a differently configured basic profile, in which the groove side walls and the end surfaces are elliptically configured, In FIGS. 3 through 6, the basic profile according to the first embodiment, having profile ribs which have a circular or elliptical contour, and In FIGS. 7 through 10, the basic profile in accordance with the second embodiment, having profile ribs extending away from the wide side surfaces, the ribs having a circularly or elliptically configured contour.

The basic profile, shown in cross-section in FIG. 1, of a key shank provided with a grip which is not illustrated, has an essentially T-shaped cross-section. The T-bar 1 extends in opposite directions at the top of the key-stem 2, and provides a guidebar with a rounded back 3. At the opposite end, the T-stem 2 forms a circular end surface 4 having a radius r.

Each of the two opposed wide side surfaces 5, 6 has a longitudinal groove 7, 8 which is such that the base 7', 8' of the groove extends inwardly beyond the longitudinal mid-plane M—M of the key shaft, achieving a paracentric configuration. The distance x of the paracentricity is the same for both longitudinal grooves 7, 8, although they can be different.

The groove sidewalls 7", 7'", 8", 8'", seen in cross-section, run circularly tangentially from the wide side surfaces 5, 6.

The radius r of these groove sidewalls corresponds to the radius r of the end surface 4. With respect to the groove sidewall 7''', there is a special case wherein the latter merges into the end surface 4, such that the extension of the wide side surface 5 is tangential exclusively to the end surface.

On the reverse side of the T-bar, the guidebar 1 forms guiding surfaces 9, 10 at right angles to the longitudinal mid-plane M—M of the T-shank. The guiding surface 10 intersects a curved line 11 which extends in the direction of the longitudinal mid-plane M—M, the curved line 11 also having a radius r, such that this curved line 11 likewise extends tangentially from the wide side surface 5.

Figure 2:
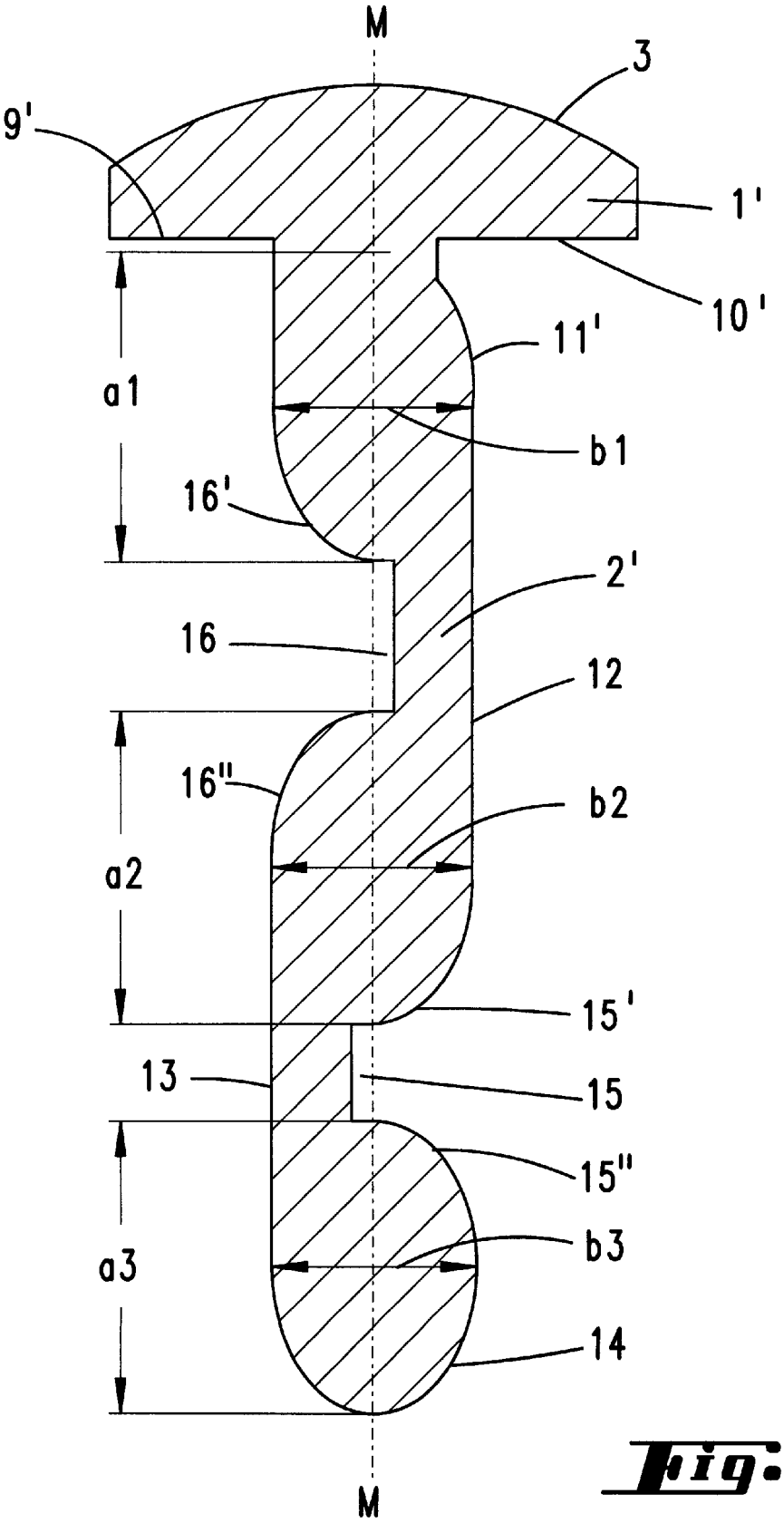

The basic profile G1 according to FIG. 2 is different from that shown in FIG. 1 in that the guide bar 1' forming the T-bar has a greater width.

In addition, the wide side surfaces 12, 13 of the T-stem 2' are spaced apart by a smaller distance than in the first embodiment of the basic profile. A further difference is that the end surface 14 has an elliptical contour. The grooves 15, 16 are likewise paracentrically arranged, while the groove sidewalls 15', 15", 16', 16" have an elliptical form. The guiding surfaces of the guide bar 1' are shown at 9' and 10'. In addition, the wide side surface 12 adjacent the guiding surface 10' extends tangentially as a curved surface 11'. The longer axes a1, a2 and a3 of the elliptical contour lines have different lengths, whereas the axes b1, b2 and b3, extending at right angles thereto, have the same measurement. However, it is also possible for the elliptical parameters lying in the longitudinal mid-plane M—M to be of the same measurement.

Figure 3:
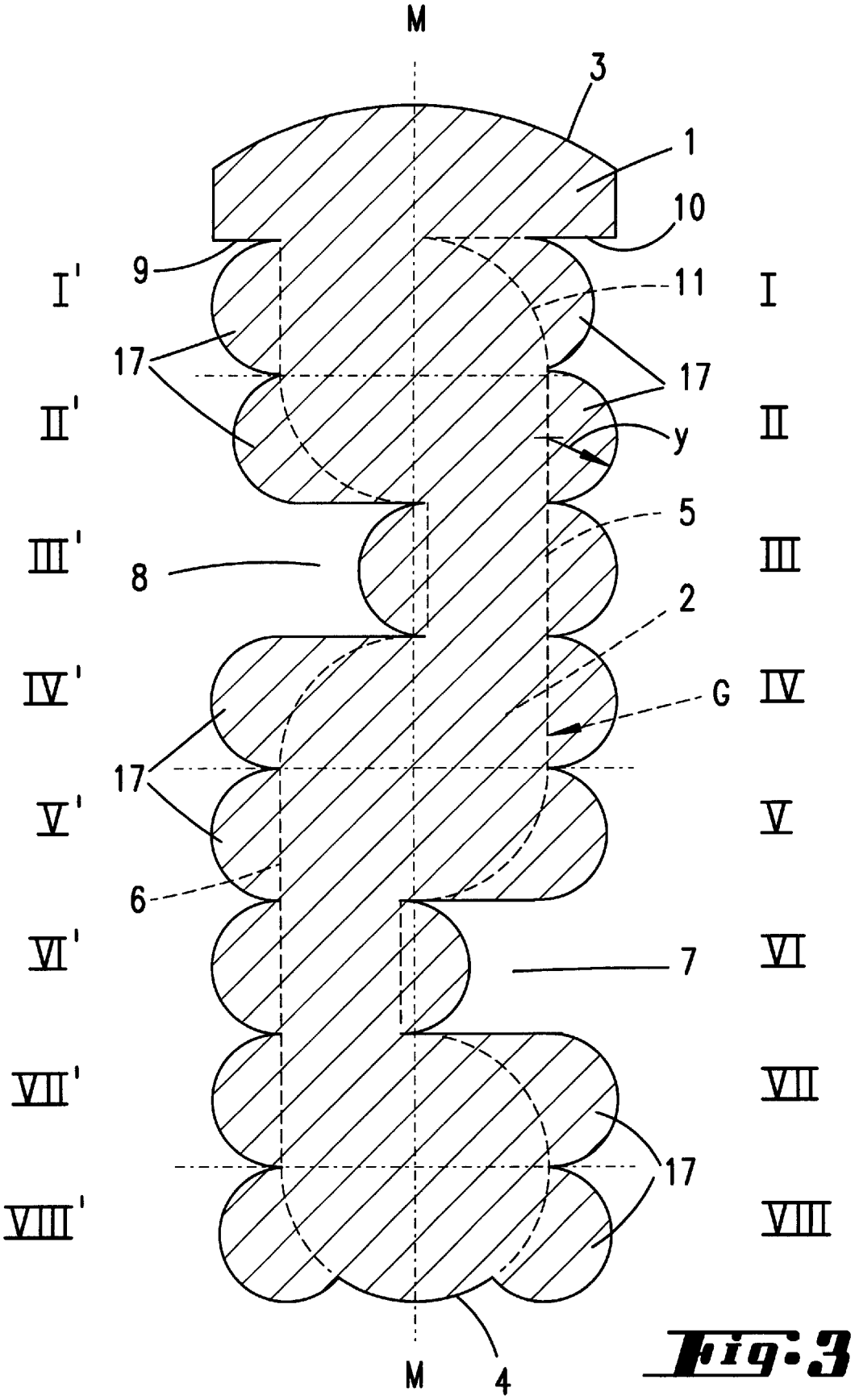

In FIG. 3 there is shown a cross-section of a key shank which makes use of the basic profile G. On both sides, the T-stem 2 is flanked at positions I through VIII and I' through VIII', by profile ribs 17 which are of circular contour. Accordingly, a key shank is created in which all the profiling—profile ribs 17, grooves 7, 8 and end surface 4—of the wide side key surfaces have rounded front and flank portions. The radius y of the profile ribs 17 is smaller than the radius r of the groove side walls 7", 7''', 8", 8''', in accordance with FIG. 1.

Figure 4:
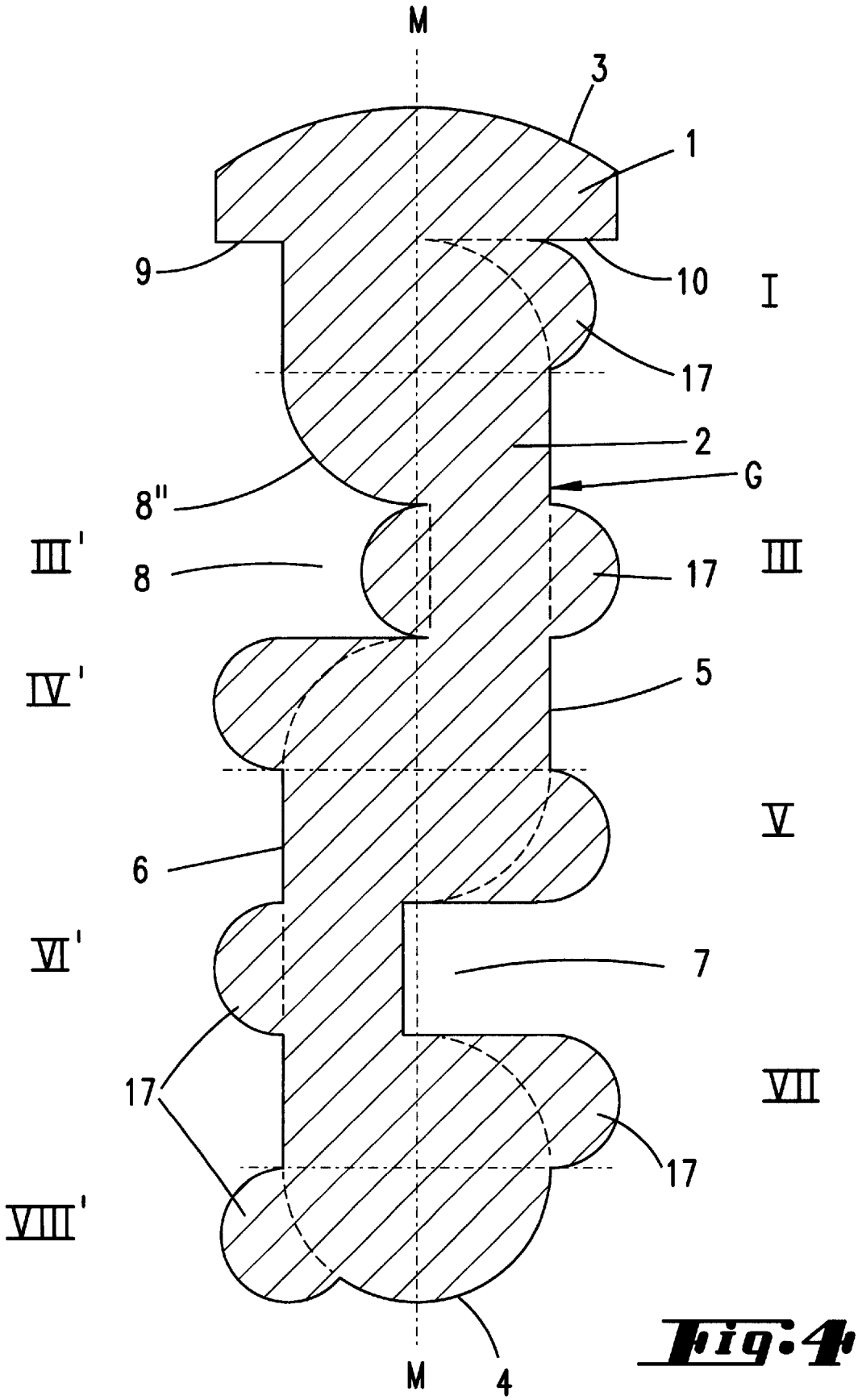

FIG. 4 shows a variation of the key shank illustrated in FIG. 3. The wide side surface 5 is flanked by profile ribs 17 only at the positions I, III, V and VII, whereas the opposite wide side surface 6 has corresponding profile ribs 17 at the positions III', IV', VI' and VIII'. Both FIG. 3 and FIG. 4 show that the distance of the rib vertexes from the longitudinal mid-plane M—M is the same as or smaller than the projection of the guide bar 1 with respect to the longitudinal mid-plane M—M.

Figure 5:
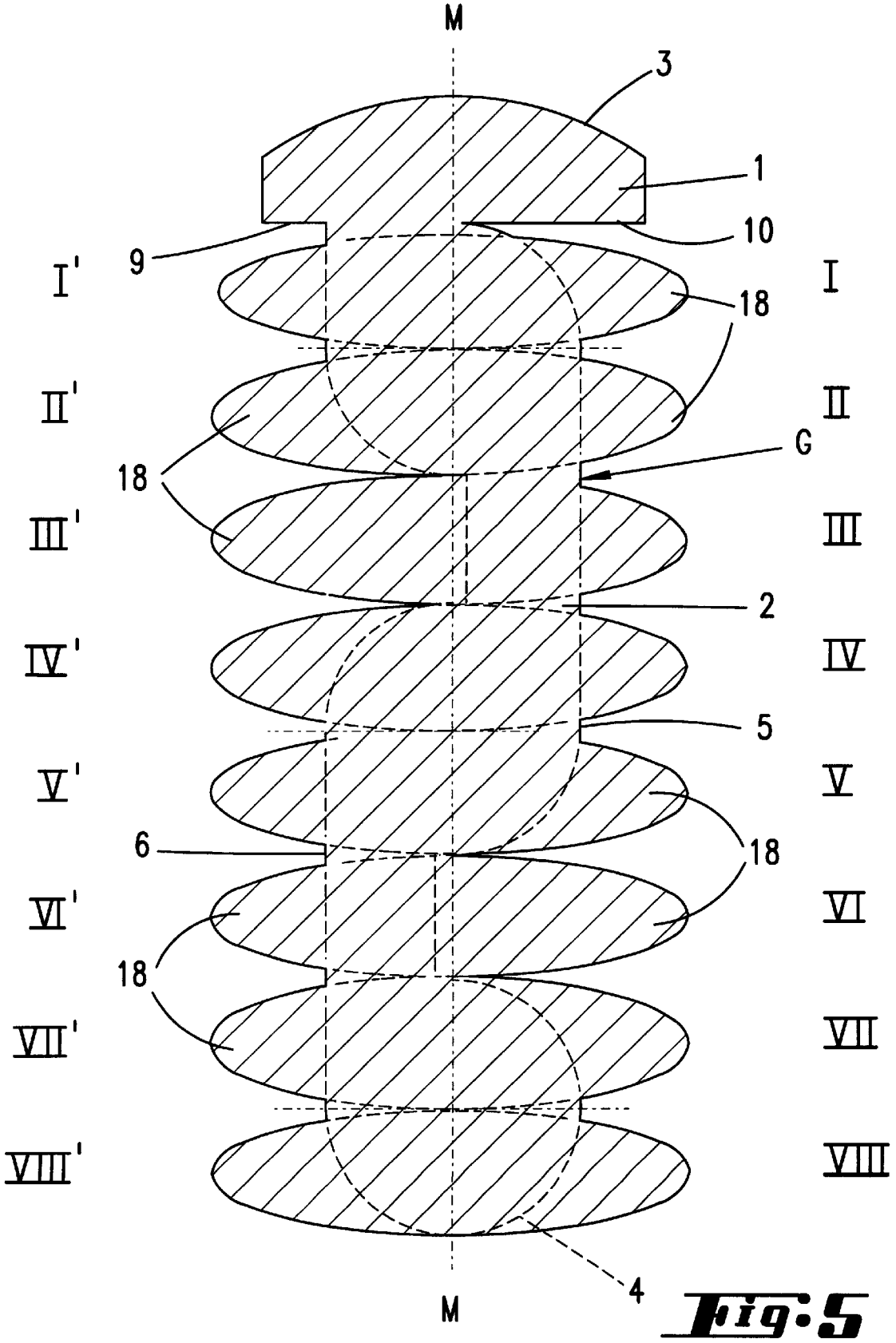

The cross-sectional profile of the key shank illustrated in FIG. 5 incorporates the basic profile G in accordance with the first embodiment. Profile ribs 18 with elliptical contours project outwardly away from the wide side surfaces, 5, 6 of the stem 2 at the positions I through VIII and I' through VIII'. One of the half axes of these profile ribs 18 lies in the longitudinal mid-plane M—M. However, a parallel arrangement is also possible. In such arrangement, the vertexes of the profile ribs 18 project slightly beyond the T-bar 1, so that the latter lies in the shadow of the adjacent profile rib 18.

Figure 6:
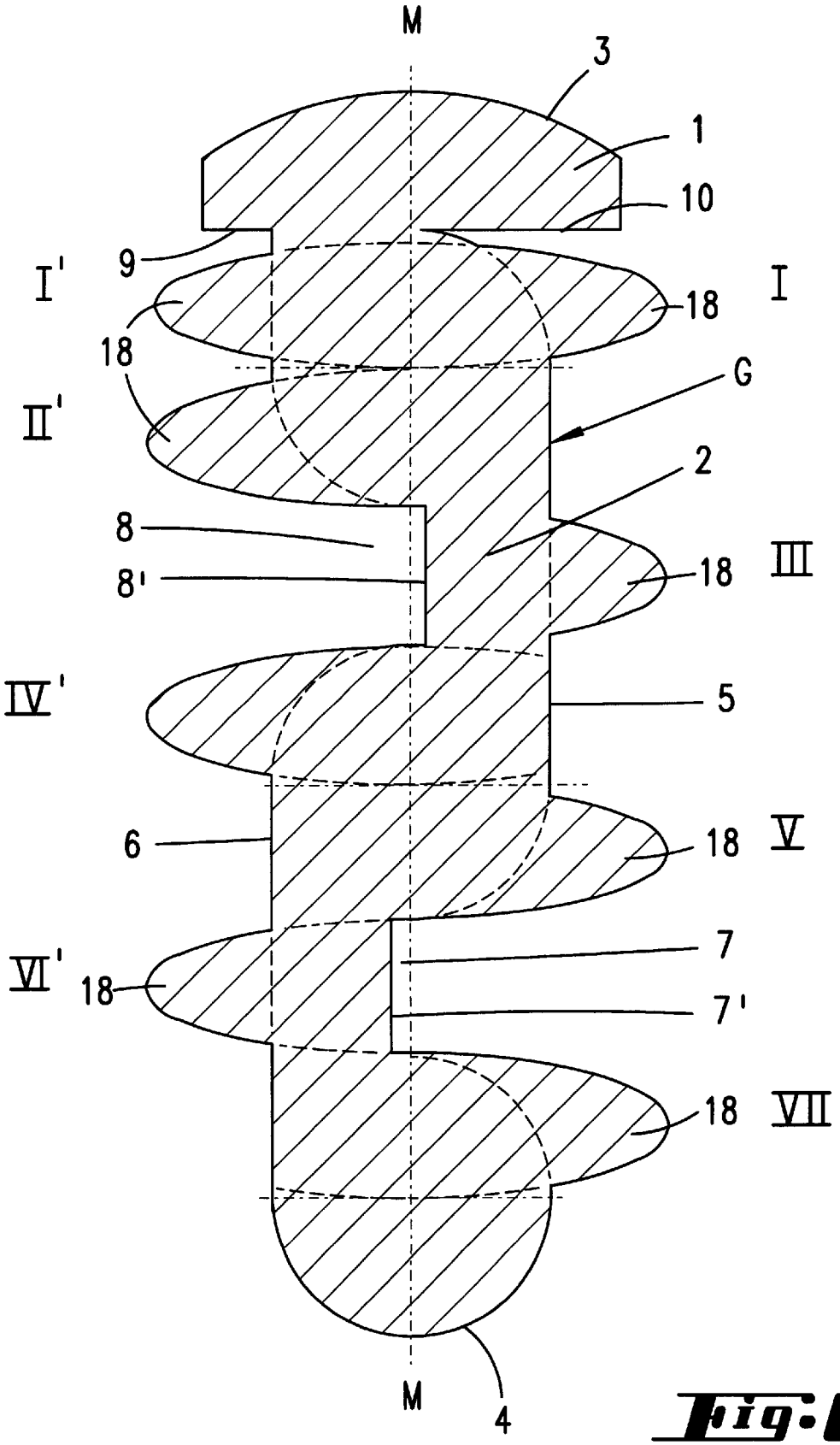

FIG. 6 discloses a variant of FIG. 5. The wide side surface 5 has projecting profile ribs 18 at the positions I, III, V and VII, whereas the opposite wide side surface 6 supports profile ribs 18 at the positions I', II', IV' and VI'.

Figure 7:
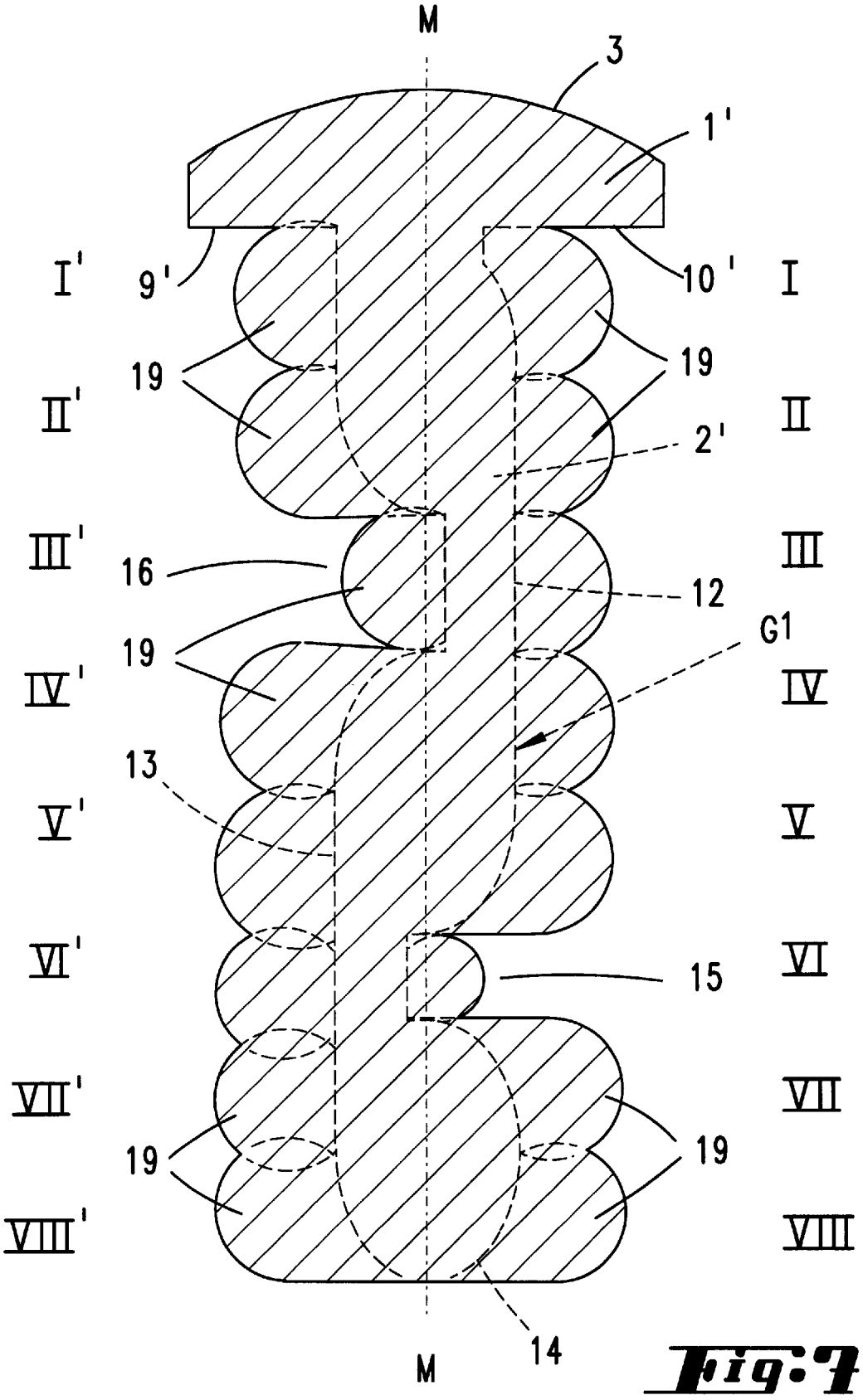

The key shank illustrated in cross-section according to FIG. 7 incorporates the basic profile G1 in accordance with the second embodiment. The wide side surfaces 12, 13 of the T-stem 2' have outwardly projecting profile ribs 19 with circular contours. The radii of these profile ribs 19 can have different measurements as is clear from position VI. The vertexes of the profile ribs 19 have a smaller spacing from the longitudinal mid-plane M—M than does the stem projection 1'. This configuration illustrates that the rib 19 generating contour lines of adjacent ribs intersect one another. The extent of the intersection can vary.

Figure 8:
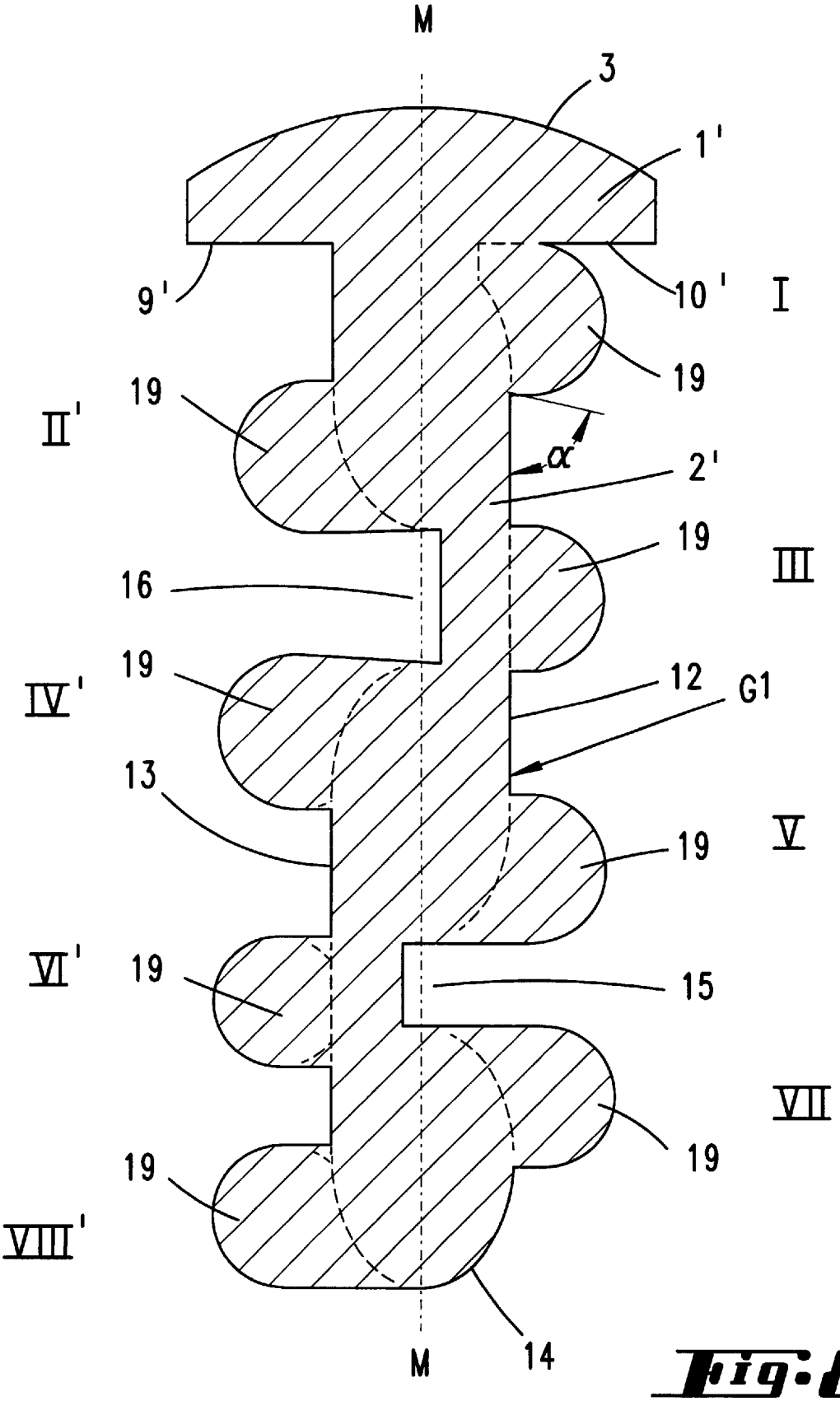

The key shank in accordance with FIG. 8 differs from that shown in FIG. 7 in that not all positions are provided with ribs 19. The wide side 12 has profile ribs 19 at the positions I, III, V and VII, whereas the wide side surface 13 has profile ribs 19 at the positions II', IV', VI' and VIII'. It can be seen in FIG. 8 that the contour line of at least one rib 19 intersects the contour line of the basic profile G' in such a way that an acute undercut is created. The acute angle is shown at alpha in position I.

Figure 9:
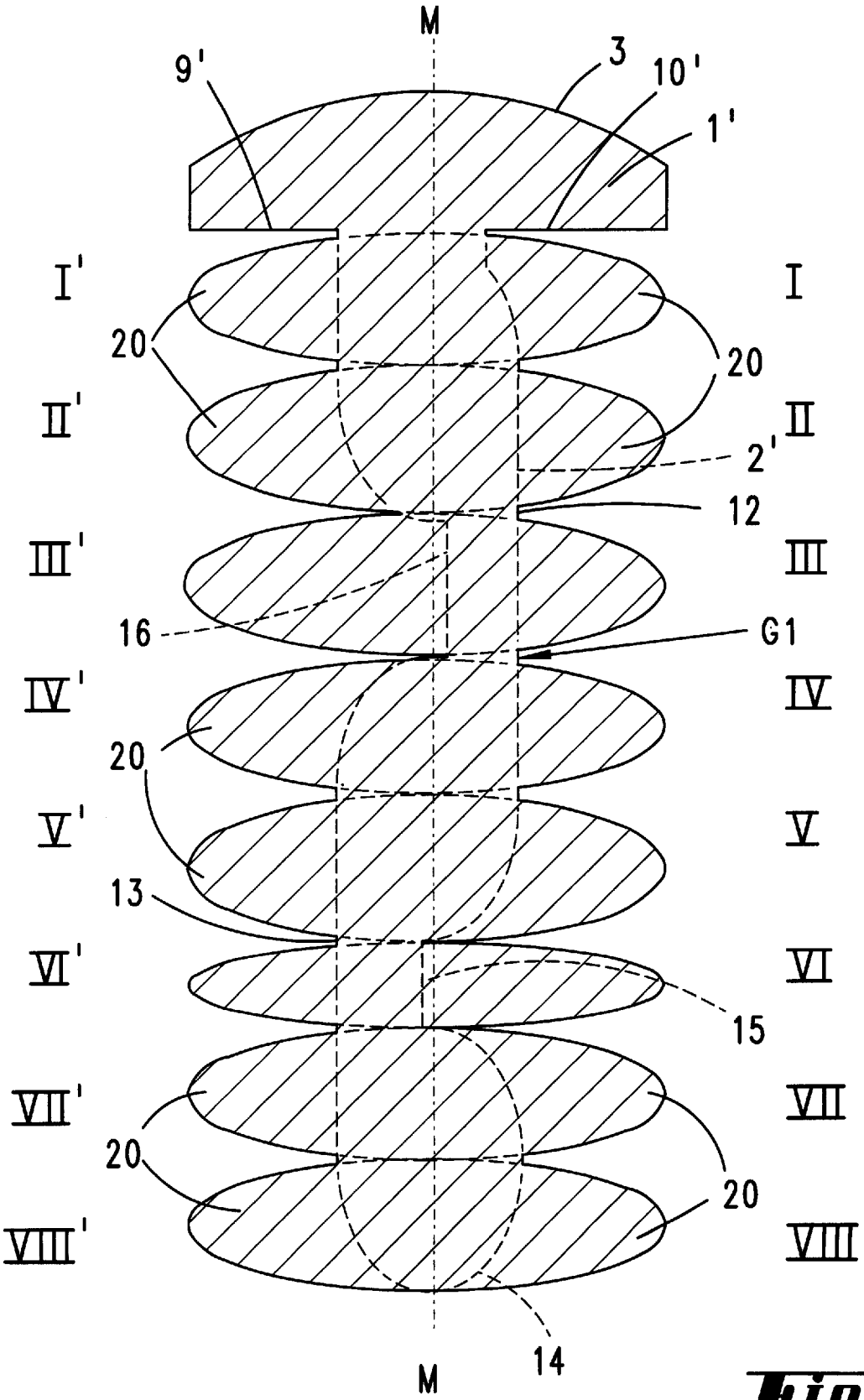

In accordance with FIG. 9, the key shank incorporates a basic profile G1. The stem 2' thereof has outwardly projecting elliptical profile ribs 20 extending from the wide side surfaces 12, 13. The vertexes of these profile ribs 20 are approximately aligned with the outer edges of the stem 1'. Thus FIG. 9 illustrates that the profile ribs provided at the positions I through VIII and I' through VIII' have varying parameters, which results in ellipses of differing widths.

Figure 10:
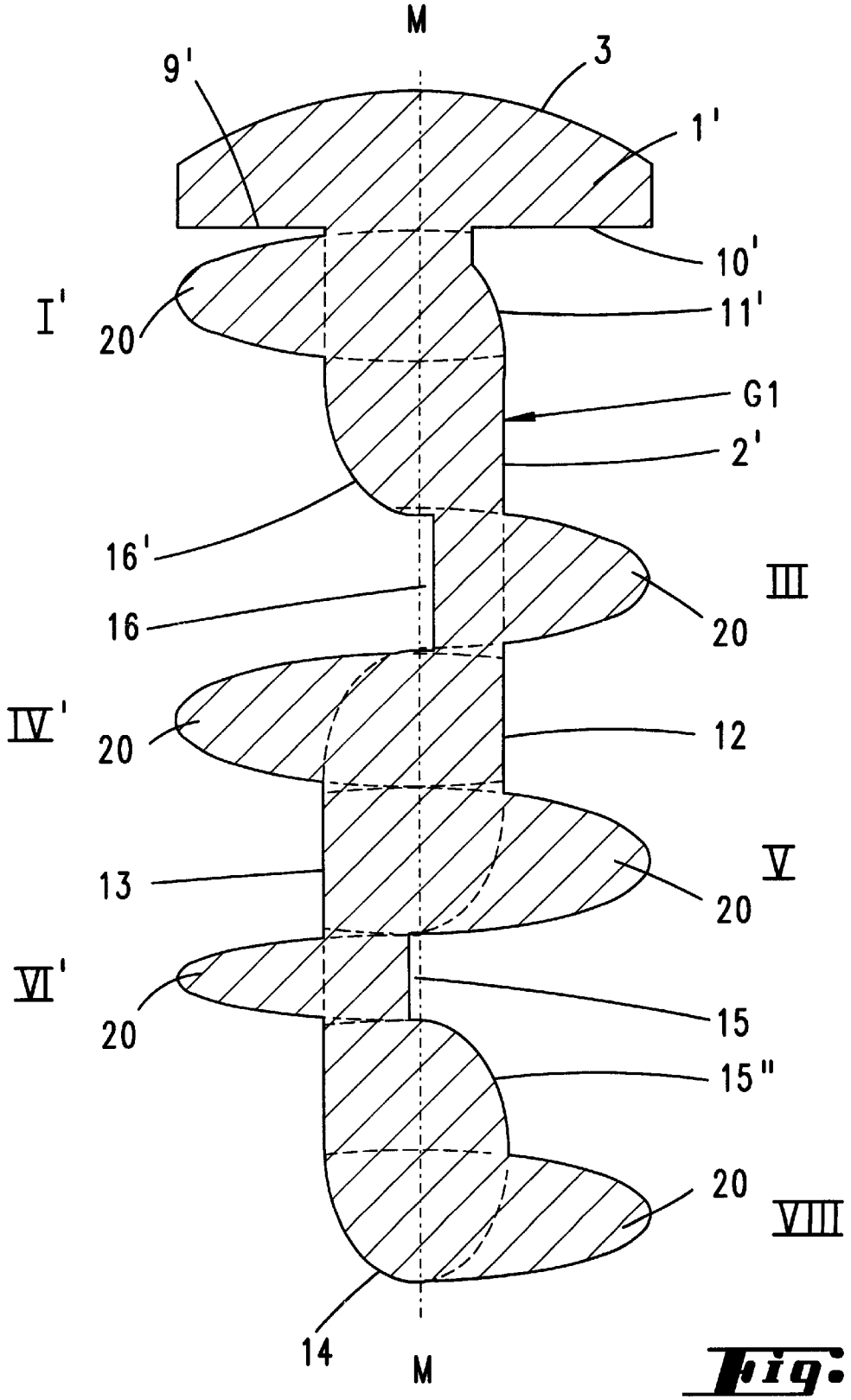

In FIG. 10 can be seen a variant of FIG. 9. Ribs 20 are provided on the wide side surface 12 at positions III, V and VIII, whereas profile ribs 18 extend from the wide side surface 13 at positions I', IV' and VI'.

Additional variations are possible. For example, the basic profile can also be a combination of the basic profiles of FIGS. 1 and 2. It would also be possible to combine profile ribs having circular and elliptical contours.

What is claimed is:

1. A flat key for use with a tumbler-containing locking cylinder of a locking apparatus, the key comprising:

a key shank having locking grooves cut into the shank, the shank having a basic profile exhibiting an essentially T-shaped cross-sectional configuration with a T-bar and a T-stem, of which the T-bar forms a guide bar with guiding surfaces, and of which the T-stem extends in a longitudinal mid-plane (M—M);

wherein a first portion of the T-stem has a first groove and a second portion of the T-stem has a second groove, the first groove being offset from the second groove along the mid-plane, said first and said second portions having respective wide side surfaces (5, 6, 12, 13) located opposite respective ones of said first and said second grooves;

each of said wide side surfaces serve as a base for profile ribs having curvilinear cross-sectional contours;

each of said first and said second grooves is a longitudinal groove (7, 8, 15, 16) with a groove base extending beyond the longitudinal mid-plane (M—M);

groove side walls (7", 7''', 8", 8''', 15', 15", 16', 16") and end surfaces (4, 14) of each of said first and said second grooves, seen in cross-section, extend in curved fashion from the wide surfaces (5, 6, 12, 13) to provide that all of the profile ribs (17, 18, 19, 20) and the grooves (7, 8, 15, 16) and the end surfaces (4, 14) of the key have rounded front and flank portions;

said first and said second grooves open into opposite sides of the mid-plane; and an intersection of two successive ones of said curvilinear cross-sectional contours is located at a distance from the mid-plane greater than a distance of a base of either one of said first and said second grooves from the mid planes;

wherein a profile of the key shank, as viewed in a plane transverse to a longitudinal axis of the key shank, is a composite of a base profile with superposed profile of a set of undulations of which any one of the undulations is a rib, there being at least one undulation in the set;

an outer edge of the rib is curved in a convex form with a radius of curvature;

the base profile is paracentric relative to a longitudinal plane of said key shank, and has at least a first portion on a first side of said longitudinal plane and at least a second portion on a second side of the longitudinal plane;

a transition from the first portion to the second portion of the base profile includes a radius of curvature substantially double the radius of curvature of the outer edge of the rib; and the undulations are disposed on a perimeter of said base profile, the undulations extending in a direction substantially perpendicular to said longitudinal plane.

2. A flat key according to claim 1, wherein the bases of the grooves (7', 8') run parallel to the longitudinal mid-plane of the key shank, and guiding surfaces (9, 10) of the guidebar (1) are perpendicular thereto.

3. A flat key according to claim 1, wherein the side walls of all the grooves (7, 8, 15, 16), including the end surfaces (4, 14) have a cross-sectional contour with common circular or elliptical parameters.

4. A flat key according to claim 1, wherein the profile ribs (17, 18, 19, 20) have a curved contour.

5. A flat key according to claim 1, wherein the distance from a top rib vertex to the longitudinal mid-plane (M—M) is the same as or smaller than a projection of the shank beyond the longitudinal mid-plane.

6. A flat key according to claim 1, wherein, with respect to contiguous ones of the ribs (19) contour lines of the ribs intersect one another.

7. A flat key according to claim 1, wherein the contour line of at least one of the ribs (19) intersects a contour line of the basic profile to form an acute angle undercut.

8. A plurality of flat keys for a plurality of tumbler-containing cylinders of locking apparatuses, wherein the locking apparatuses comprise a plurality of locking cylinders operable with a corresponding number of flat keys each of which comprises:

a key shank having locking grooves cut into the shank, the shank having a basic profile exhibiting an essentially T-shaped cross-sectional configuration with a T-bar and a T-stem, of which the T-bar forms a guide bar with guiding surfaces, and of which the T-stem extends in a longitudinal mid-plane (M—M);

wherein a first portion of the T-stem has a first groove and a second portion of the T-stem has a second groove, the first groove being offset from the second groove along the mid-plane, said first and said second portions having respective wide side surfaces (5, 6, 12, 13) located opposite respective ones of said first and said second grooves;

each of said wide side surfaces serve as a base for profile ribs having curvilinear cross-sectional contours;

each of said first and said second grooves is a longitudinal groove (7, 8, 15, 16) with a groove base extending beyond the longitudinal mid-plane (M—M);

groove side walls (7", 7'", 8", 8'", 15', 15", 16', 16") and end surfaces (4, 14) of each of said first and said second grooves, seen in cross-section, extend in curved fashion from the wide surfaces (5, 6, 12, 13) to provide that all of the profile ribs (17, 18, 19, 20) and the grooves (7, 8, 15, 16) and the end surfaces (4, 14) of the key have rounded front and flank portions;

said first and said second grooves are disposed on opposite sides of the mid-plane; and an intersection of two successive ones of said curvilinear cross-sectional contours is located at a distance from the mid-plane greater than a distance of a base of either one of said first and said second grooves from the mid plane; and wherein at least two of said flat keys are differently constructed by a differing disposition of the profile ribs (17 to 20);

wherein a profile of the key shank, as viewed in a plane transverse to a longitudinal axis of the key shank, is a composite of a base profile with superposed profile of a set of undulations of which any one of the undulations is a rib, there being at least one undulation in the set;

an outer edge of the rib is curved in a convex form with a radius of curvature;

the base profile is paracentric relative to a longitudinal plane of said key shank, and has at least a first portion on a first side of said longitudinal plane and at least a second portion on a second side of the longitudinal plane;

a transition from the first portion to the second portion of the base profile includes a radius of curvature substantially double the radius of curvature of the outer edge of the rib; and the undulations are disposed on a perimeter of said base profile, the undulations extending in a direction substantially perpendicular to said longitudinal plane.

9. A flat key according to claim 1, wherein said curved fashion is circularly tangentially.

10. A flat key according to claim 4, wherein the curved contour is circular.

11. A flat key for use with a tumbler-containing locking cylinder of locking apparatus, the key comprising:

a key shank extending along a longitudinal axis, and having locking grooves extending along a surface of the shank parallel to said longitudinal axis;

wherein a profile of the key shank, as viewed in a plane transverse to said longitudinal axis of the key shank, is a composite of a base profile with superposed profile of a set of undulations of which any one of the undulations is a rib, there being at least one undulation in the set;

said base profile is paracentric relative to a longitudinal plane of said key shank, and has at least a first portion on a first side of said longitudinal plane and at least a second portion on a second side of said longitudinal plane;

a transition from the first portion to the second portion of said base profile includes a radius of curvature substantially double the radius of curvature of the outer edge of said rib; and said undulations are disposed on a perimeter of said base profile, the undulations extending in a direction substantially perpendicular to said longitudinal plane.

* * * * *